US011826784B2

(12) United States Patent
Leinonen

(10) Patent No.: US 11,826,784 B2
(45) Date of Patent: Nov. 28, 2023

(54) SCREENING DEVICE

(71) Applicant: Metso Outotec Finland Oy, Tampere (FI)

(72) Inventor: Timo Leinonen, Kangasala (FI)

(73) Assignee: Metso Outotec Finland Oy, Tampere (FI)

( * ) Notice: Subject to any disclaimer, the term of this patent is extended or adjusted under 35 U.S.C. 154(b) by 0 days.

(21) Appl. No.: 17/637,967

(22) PCT Filed: Aug. 27, 2020

(86) PCT No.: PCT/EP2020/074027
§ 371 (c)(1),
(2) Date: Feb. 24, 2022

(87) PCT Pub. No.: WO2021/038011
PCT Pub. Date: Mar. 4, 2021

(65) Prior Publication Data

US 2022/0274136 A1 Sep. 1, 2022

(30) Foreign Application Priority Data

Aug. 27, 2019 (EP) ..... 19193866

(51) Int. Cl.
*B07B 1/46* (2006.01)
*B07B 1/44* (2006.01)

(52) U.S. Cl.
CPC ..... *B07B 1/4645* (2013.01); *B07B 1/44* (2013.01); *B07B 2201/02* (2013.01)

(58) Field of Classification Search
CPC ..... B07B 2201/02
(Continued)

(56) References Cited

U.S. PATENT DOCUMENTS 6,019,228 A * 2/2000 Duggan ..... B07B 1/4645 209/412
6,267,246 B1 * 7/2001 Russell ..... B07B 1/469 209/408
2010/0006481 A1 * 1/2010 Waites, Jr. ..... B07B 1/4645 209/405

FOREIGN PATENT DOCUMENTS

DE 202009016047 U1 2/2010
DE 202009016047 U1 * 3/2010 ..... B07B 1/12
(Continued)

OTHER PUBLICATIONS

International Search Report and Written Opinion for International Patent Application No. PCT/EP2020/074027 dated Jun. 22, 2021.
(Continued)

*Primary Examiner* — Terrell H Matthews
(74) *Attorney, Agent, or Firm* — ANDRUS INTELLECTUAL PROPERTY LAW, LLP

(57) ABSTRACT

A modular screen support deck for a screening arrangement includes a first deck side having an inward facing side and an outward facing side and a second deck side having an inward facing side and an outward facing side. The first and second deck sides extend in parallel with each other to define a deck plane. A first extension structure is connected to the first deck side and extends inwardly from the first deck side. The first extension structure includes a first connection structure and a second extension structure connected to the second deck side and extending inwardly from the second deck side. The second extension structure includes a second connection structure arranged a distance from the second deck side. The support deck includes a first cross-member with a first and second ends, the first end being connected to the first connection structure and the second end being connected to the second connection structure.

15 Claims, 2 Drawing Sheets

(58) Field of Classification Search
USPC ..... 209/405
See application file for complete search history.

(56) References Cited

FOREIGN PATENT DOCUMENTS

| | | | | |
|---|---|---|---|---|
| EP | 3785811 A1 * | 3/2021 | ..... | B07B 1/44 |
| GB | 2092917 A * | 8/1982 | ..... | B07B 1/4645 |
| GB | 2092917 A | 8/1982 | | |
| WO | 9911394 A1 | 3/1999 | | |
| WO | WO-9911394 A1 * | 3/1999 | ..... | B01D 33/0376 |

OTHER PUBLICATIONS

International Preliminary Report on Patentability for International Patent Application No. PCT/EP2020/074027 dated Jul. 28, 2021.

* cited by examiner

SCREENING DEVICE

CROSS-REFERENCE TO RELATED APPLICATIONS

This application is the U.S. national stage application of International Application PCT/EP2020/074027, filed Aug. 27, 2020, which international application was published on Mar. 4, 2021, as International Publication WO 2021/038011 A1 in the English language. The International Application claims priority of European Patent Application 19193866.1, filed Aug. 27, 2019.

FIELD OF THE INVENTION

The present invention relates to a modular screen support deck, a screening arrangement and a screening arrangement for use in material screening in a mobile material processing plant.

BACKGROUND

Vibrating screening arrangements are used to sort particles and other materials dependent on size. The sorting is accomplished by causing materials to vibrate over some type of porous planar surface. Particles that fall through openings in a porous surface are of one size and particles that do not fall through, but pass over these same openings are of another size.

Prior art screening arrangements often comprise a plurality of sequentially arranged screening elements for categorizing a material stream into different size categories. Such Screening arrangements customarily has a frame of transversely spaced spring-mounted side walls, in-between the side walls are screen support decks used for mounting screening elements. The screen support decks are in some cases bolted to the side walls. To keep the sidewalls together and to add structural integrity to the screening arrangement, the screen support decks may comprise a plurality of cross-members. These cross-members may be welded at their ends to the screen support decks.

A problem with these prior art screening arrangements, is that vibration of the screening arrangement induces stresses in the welded connections of the screening arrangement. These stresses are mostly induced because of the side walls flexing in response to the vibrations. This problem is further worsened by it being difficult to relief these stresses, and the welded connection are not adapted to yield without fracturing in response to the flexing of the side walls.

As a result of this, the welded connections risk fracturing at an early stage, thereby severely decreasing the life time of such a screening arrangement and increasing costly repairs which can hold up a whole production line.

SUMMARY OF THE INVENTION

An object of the present invention is therefore to alleviate the abovementioned problems and provide a modular screen support deck that allows convenient connection of cross-members to achieve an improved life time of a modular screen support deck.

The above and other objects which will be evident from the following description are achieved by a modular screen support deck according to a first aspect of the present invention, by a screening arrangement according to a second aspect of the present invention, and by a mobile material processing plant according to a third aspect of the present invention.

According to the first aspect of the present invention, a modular screen support deck is provided. said modular screen support deck comprising: a first deck side and a second deck side each having an inward facing side and an outward facing side, the first deck side and the second deck side extend in parallel with each other defining a deck plane between the two deck sides, a first extension structure and a second extension structure, the first extension structure being connected to the first deck side and the second extension structure being connected to the second deck side, the first extension structure extending inwardly from the first deck side and comprising a first connection structure being arranged a distance from the first deck side, the second extension structure being connected to the second deck side, extending inwardly from the second deck side, and comprising a second connection structure being arranged a distance from the second deck side, a first cross-member with a first end and a second end, the first end of the first cross-member being connected to the first connection structure to allow the first extension structure to dampen vibrations in the connection between the first end of the first cross-member and the first connection structure, and the second end of the first cross-member being connected to the second connection structure to allow the second extension structure to dampen vibrations in the connection between the second end of the first cross-member and the second connection structure. By the inward facing side of the first screen deck side is meant the side of the first screen deck side which faces the inward facing side of the second screen deck side. The outward facing side is the opposite side to the inward facing side.

By a deck plane is meant a plane which extends in-between the first deck side and the second deck side. The deck plane may some cases be parallel to a horizontal plane, e.g. if the modular screen support deck is installed in a horizontal screening arrangement, alternatively the deck plane may have an incline relative to the horizontal plane, e.g. if the modular screen support deck is installed in an inclined screening arrangement.

Preferably, the first deck side and the second deck side are configured to extend longitudinally in parallel with a longitudinal direction of a screening arrangement in which the modular screen support deck is installed.

Having the extension structures configured to dampen vibrations, gives the advantage of reducing negative effects caused by vibrations, e.g. flexing in the connection leading to the connection between the modular screen support deck and the first cross-member weakening and possibly failing due to fatigue. Especially in screening arrangements is this an advantage, as screening arrangements generally will have a moving mechanical component inducing vibrations in the screening arrangement, these vibrations generally lead to flexing of the deck sides, which in return weakens and possibly leads to failure of the connection between the deck sides and the first cross-member. However, since the extension structures are configured to dampen vibrations, the flexing happening in the connection between the extension structure and the first cross-member is lowered, thus lowering the strain on the connection between the extension structure and the first cross-member. Thus, by reducing vibrations in the connection between the first cross-member and the support structures, the amount of fatigue occurring in the connections may be reduced, which in return leads to a higher life time expectancy of the modular screen support deck and as a consequence of that, a higher life time expectancy of the screening arrangement in which the modular screen support deck is installed.

According to one exemplary embodiment of the first aspect of the present invention the first extension structure and the second extension structure each comprises a substantially horizontal part extending towards the opposing deck side, and a substantially vertical part connected to the horizontal part and extending perpendicular to the deck plane, the vertical part of the first extension structure comprising the first connection structure and the vertical part of the second extension structure comprising the second connection structure, wherein the connections between the horizontal parts and the vertical parts is configured to act as vibration dampers.

By providing a simple structure, which moves the connection away from the deck sides and provides a connection structure, the advantages of saving weight and not requiring extensive customization for the ends of the first cross-member are achieved. Furthermore, the connections between the horizontal parts and the vertical parts may act as a damper, by allowing elastic movement in the connection, thereby dampening vibrations. Preferably, the connection structure is provided as a connection surface extending perpendicular to the deck plane.

According to one exemplary embodiment of the first aspect of the present invention, an angle between the horizontal parts of the first extension structure and the second extension structure and the deck plane is in the range of 0 degrees to 15 degrees.

A small angle between the deck plane and the horizontal parts may facilitate spring-like movement of the extension structures, thereby further dampening vibrations and deformation in the connection between the first cross-member and the connection structures.

According to one exemplary embodiment of the first aspect of the present invention the first end and the second end of the first cross-member is connected to the first connection structure and the second connection structure by welding.

Welding provides a strong and permanent connection which may be preferable if the modular support deck is to be use for a long time period. Alternatively, the connection may be made with a bolt connection, which may facilitate easy repair and replacement of the different parts.

According to one exemplary embodiment of the first aspect of the present invention the modular screen support deck comprises at least two first cross-members.

By having more than one first cross-members the stresses experienced may be distributed, which may alleviate stresses in the connection between the first cross-member and the modular screen support deck. Extra structural integrity may also be conferred to the modular screen support deck by having more than one first cross-member, thus making the modular screen support deck more rigid and capable of withstanding higher loads. Though a balance needs to be kept as adding more first cross-members means adding more weight, so balance between structural integrity and weight needs to be kept. Each of the more than one first cross-members may be connected to separate extension structures or to the same extension structure. The modular screen support deck may also comprise three, four, five or more first cross-members.

According to one exemplary embodiment of the first aspect of the present invention the modular screen support deck comprises a second cross-member with a first end and a second end, a third deck side and a fourth deck side each having an inward facing side and an outward facing side, the third deck side and the fourth deck side extends in parallel with each other perpendicular to the first deck side and the second deck side, ends of the third deck side and the fourth side being connected to the first deck side and the second deck side, and the first end of the second cross-member is connected to the third deck side and the second end the second cross-member is connected to the fourth deck side.

Preferably, the third deck side and the fourth deck side are configured to extend longitudinally perpendicular to a longitudinal direction of a screening arrangement in which the modular screen support deck is installed. Adding second cross-members may add rigidity and structural integrity to the modular support deck, making it more resistant towards twisting and shear stresses in a direction perpendicular to the first deck side and the second deck side.

According to one exemplary embodiment of the first aspect of the present invention the second cross-member is configured to accommodate at least part of the first cross-member.

Having the first cross-member accommodated at least partly in the second cross-member may protect the first cross-member from buckling. This may be achieved by using the second cross-member as a brace for the first cross-member. The second cross-member may comprise a notch which is configured to go into engagement with the first cross-member, thereby bracing the first cross-member. Alternatively, the second cross-member may comprise a through-going hole, which the first cross-member may pass through, the through-going hole having substantially the same shape as the cross-section of the first cross-member.

According to one exemplary embodiment of the first aspect of the present invention the modular screen support deck comprises at least three second cross-members.

By having more than one second member cross-member the stresses experienced may be distributed, which may alleviate stresses between the different second cross-members. Extra structural integrity may also be added to the modular screen support deck making it more rigid and capable of withstanding higher loads. Though a balance needs to be kept as adding more second cross-members means adding more weight, so balance between structural integrity and weight needs to be kept.

According to one exemplary embodiment of the first aspect of the present invention the distance between the first connecting structure and the first deck side is in the range of 40 mm to 150 mm, and the distance between the second connecting structure and the second deck side is in the range of 40 mm to 150 mm.

By moving the connecting structures at least 40 mm away from the deck sides it may ensure that the connecting structures are far enough removed to avoid contacting the deck sides if flexing happens in the extension structure during operation of a screening arrangement wherein the modular screen support deck is installed. Of course the connecting structures may be moved farther away than 40 mm, but again a balance has to be found with added weight, it has therefore been found that moving it a distance which is within the interval 40 mm to 150 mm strikes a good balance. Also, the farther away from the deck side the connecting structure is, the larger the so-called dead area beneath a screen attached to the screen support deck will be.

According to one exemplary embodiment of the first aspect of the present invention the inward facing side of the third deck side and the fourth deck is folded to form a substantial U-shape.

By folding the third deck side and the fourth side into a U-shape a higher rigidity is achieved, without increasing the weight of the third deck side and fourth deck side unnecessarily. A higher rigidity may counter-act flexing the deck sides. The legs of the U-shape preferably extend towards the opposing deck side in parallel with the deck plane.

According to the second aspect of the present invention a screening arrangement for screening particulate material according to size is provided, said screening arrangement comprising a first side wall and a second side wall, each having an inward facing side and an outward facing side, a modular screen support deck according to the first aspect of the invention, the modular screen support deck extending between said inward facing sides of the first side wall and the second side wall.

According to one exemplary embodiment of the second aspect of the present invention the screening arrangement comprises a vibrating mechanism, which is configured to vibrate the screening arrangement.

According to the third aspect of the present invention a mobile material processing plant is provided, said mobile processing plant comprising a screening arrangement according to the second aspect of the present invention.

Other objectives, features and advantages of the present inventive concept will appear from the following detailed disclosure, from the attached claims as well as from the drawings. A feature described in relation to one of the aspect may also be incorporated in the other aspect, and the advantage(s) of the feature is applicable to all aspects in which it is incorporated.

BRIEF DESCRIPTION OF THE DRAWINGS

The above, as well as additional objects, features and advantages of the present inventive concept, will be better understood through the following illustrative and non-limiting detailed description, with reference to the appended drawings. In the drawings like reference numerals will be used for like elements unless stated otherwise.

DETAILED DESCRIPTION OF THE DRAWINGS

In the present detailed description, embodiments of a modular screen support deck according to the present invention are mainly discussed with reference to drawings showing the modular screen support deck and/or a screening device with components and portions being relevant in relation to various embodiments of the invention. It should be noted that this by no means limits the scope of the invention, which is also applicable in other circumstances for instance with other types or variants of screening arrangements or screening devices than the embodiments shown in the appended drawings. Further, that specific features are mentioned in connection to an embodiment of the invention does not mean that those components cannot be used to an advantage together with other embodiments of the invention.

The invention will now by way of example be described in more detail by means of embodiments and with reference to the accompanying drawings.

Figure 1:
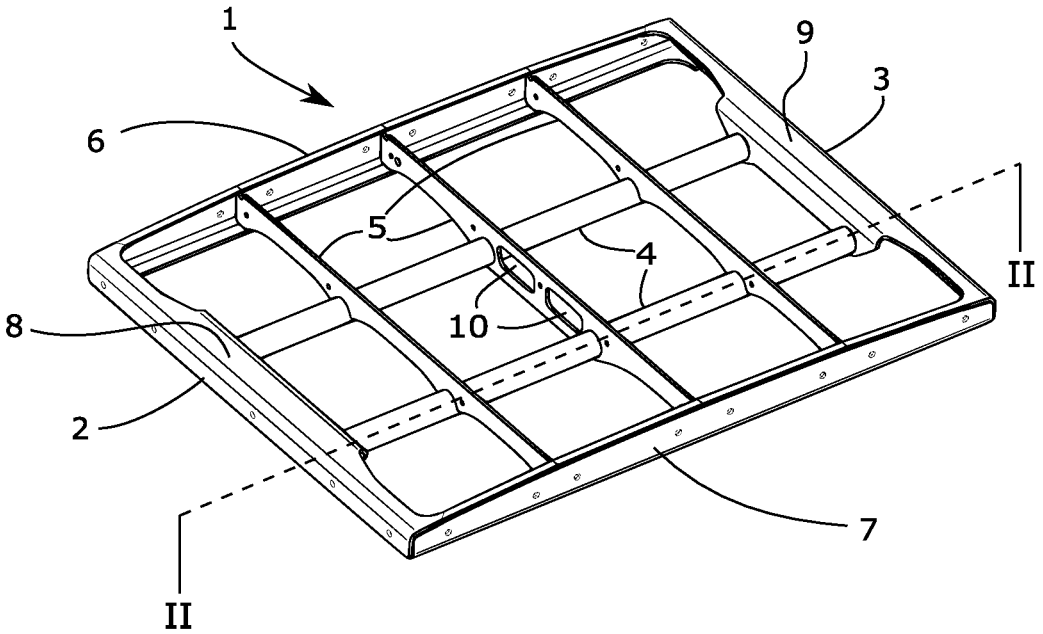
FIG. 1 is a perspective view illustrating a modular screen support deck according to an embodiment of the invention.

Referring initially to FIG. 1, which is a perspective view illustrating a modular screen support deck 1 according to an embodiment of the invention.

The modular screen support deck 1 comprises a first deck side 2 and a second deck side 3. The first deck side 2 and the second deck side 3 both comprises an inward facing side and an outward facing side, where the inward facing side for the first deck side 2 is the side facing towards the second deck side 3, and where the inward facing side for the second deck side 3 is the side facing towards the first deck side 2. The first deck side 2 and the second deck side 3 may be made out of metal, preferably steel. The first deck side 2 and the second deck side 3 may alternatively, be fabricated using a plurality of materials, such as polymers and steel. The first deck side 2 and the second deck side 3 extend in parallel with each other. The first deck side 2 and the second deck side 3 together define a deck plane D. The deck plane D being defined as a geometric plane extending between the two deck sides. The deck plane D is shown on FIG. 2.

Connected to the first deck side 2 is the first extension structure 8 and connected to the second deck side 3 is the second extension structure 9. The extension structures may be integrally connected to the deck sides, either from being made from the same piece of material, e.g. the first extension structure 8 and the first deck side 2 being shaped from the same piece of material by folding, or the extension structures may be welded onto the deck sides fusing the two together. Alternatively, the extension structures may be connected to the deck sides by bolting. The extension structures will be described in greater detail in relation to FIGS. 2 and 3.

In the shown embodiment two first cross-members 4 extend between the first deck side 2 and the second deck side 3. Though two first cross-members 4 are shown, the invention is not limited to this and the modular screen support deck 1 may comprise one or more than two first cross-members 4. The first cross-members 4 may have a general tubular shape as shown, or they may have a general box shape or prism shape or any other suitable shape. The first cross-members 4 extend preferably linearly between the first deck side 2 and the second deck side 3, but may also bend between the first deck side 2 and the second deck side 3. The first cross-members 4 may be fabricated using a plurality of materials, such as polymers and/or steel. The first cross-members 4 each comprises a first end and a second end, the first end being connected to the first extension structure 8, and the second end being connected to the second extension structure 9. The connections may preferably be made by welding but e.g. bolting is also conceivable. In some embodiments each end of the first cross-members 4 may also be connected to one extension structure 8 associated with each end of the first cross-members 4.

The modular screen support deck 1 may also comprise a third deck side 6 and a fourth deck side 7 as shown in FIG. 1. The third deck side 6 and the fourth deck side 7 both comprises an inward facing side and an outward facing side, where the inward facing side for the third deck side 6 is the side facing towards the fourth deck side 7, and where the inward facing side for the third deck side 6 is the side facing towards the fourth deck side 7. The third deck side 6 and the fourth deck side 7 may be made out of metal, preferably steel. The third deck side 6 and the fourth deck side 7 may alternatively, be fabricated using a plurality of materials, such as polymers and steel. The third deck side 6 and the fourth deck side 7 extend in parallel with each other. The inward facing side of the third deck side 6 and the fourth deck side 7 may be folded to increase the rigidity. The third deck side 6 and the fourth deck side 7 may be folded to form a L-shape, a U-shape or similar shapes, which may act to increase the rigidity of the third deck side 6 and the fourth deck side 7. The first deck side 2, the second deck side 3, the third deck side 6, and the fourth deck side 7 may be connected together to form an outer frame of the modular screen support deck 1. The first deck side 2 and the second deck side 3, is preferably connected to the third deck side 6 and fourth deck side 7 so the shape of the modular screen support deck 1 is generally rectangular. The deck sides may be connected by bolting or welding.

The modular screen support deck 1 may also comprise second cross-members 5 as shown in FIG. 1. The second cross-members 5 may have a general box shape as shown, or they may have a general tubular shape or prism shape or any other suitable shape. The second cross-members 5 may be fabricated using a plurality of materials, such as polymers and/or steel. The second cross-members 5 may be adapted to accommodate at least part of the first cross-members 4. This may be achieved by notches or through-going holes in the second cross-members 5. The second cross-members 5 may also be provided with additional through-going holes 10 to reduce the weight of the second cross-members 5. In the shown embodiment the modular screen support deck 1 has three second cross-members 5, the invention is not limited to this and the modular screen support deck 1 may comprise one, two or more than three second cross-members 5. The second cross member 5 comprises a first end and a second end, the first end of the second cross-member 5 is connected to the third deck side 6 and the second end of the second cross-member is connected to the fourth deck side 7.

Figure 2:
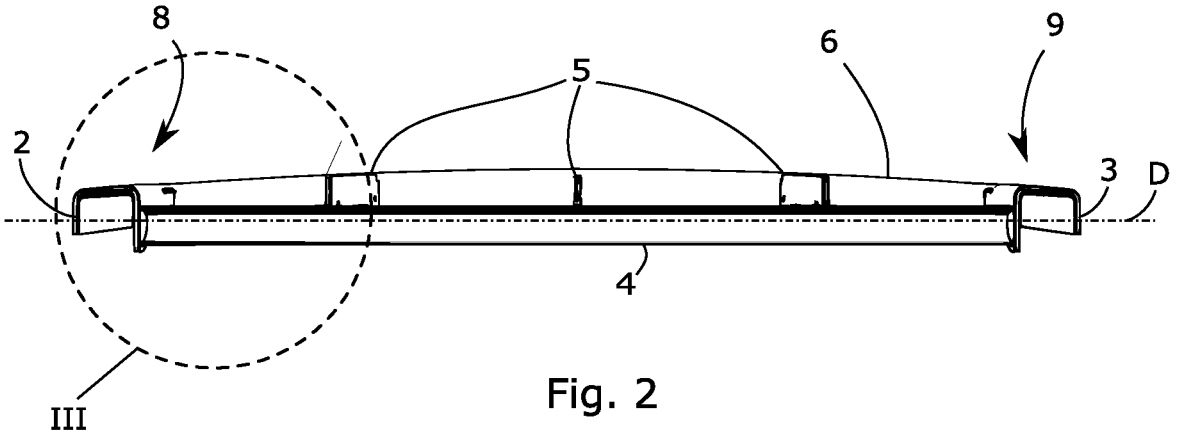
FIG. 2 is a cross-sectional side view of the modular screen support deck of FIG. 1 along line II-II.
Figure 3:
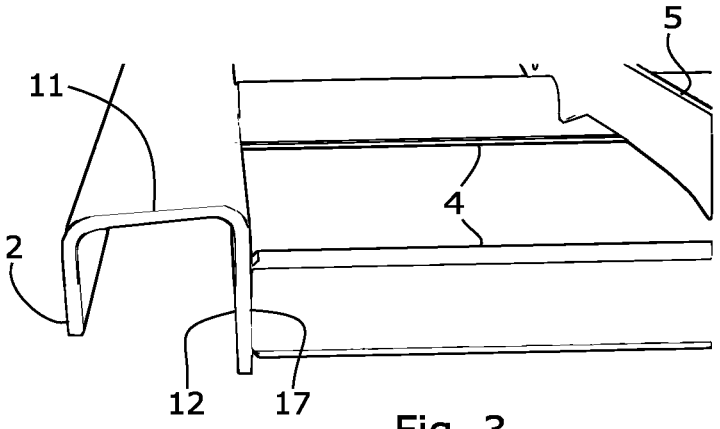
FIG. 3 is a close up cross-sectional side view of the modular screen support deck of FIG. 2 within circle III.

Referring to FIGS. 2 and 3, where FIG. 2 is a cross-sectional side view of the modular screen support deck of FIG. 1 along line II-II, and FIG. 3 is a close up cross-sectional side view of the modular screen support deck of FIG. 2 within circle III.

The FIGS. 2 and 3 will now be described with a focus on the first deck side 2 and the first extension structure 8, though everything described with regards to the first deck side 2 and the first extension structure 8 may be correspondingly applied to the second deck side 3 and second extension structure 9. The first extension structure 8 in the shown embodiment comprises a substantially horizontal part 11 extending inwardly from the deck sides, and a substantially vertical part 12 extending perpendicular to the deck plane D. The first extension structure 8 may comprise more parts, but for simplicity and to keep weight low a simple structure is preferable. The horizontal part 11 may also act as a support surface for a screening element. The vertical part 12 of the first extension structure 8 comprises a connection structure 17. The connection structure 17 being where the first cross-member 4 and the first extension structure 11 are connected. The connection structure 17 and the first cross-member 4 may be connected by welding or bolting. As shown the connection structure 17 may be presented as a connection surface extending perpendicular to the deck plane D. The horizontal part 11 of the first extension structure 8 may extend inwardly substantially in parallel with the deck plane D. The horizontal part 11 of the first extension structure 8 may alternatively extend substantially inwardly with an angle to the deck plane D, the angle is preferably in the range of 0 degrees to 15 degrees. The connection structure 17 of the first extension structure 8 is arranged a distance from the first deck side 2. The distance may be created by letting the horizontal part 11 of the first extension structure 8 act as a spacer, by having one end of the horizontal part 11 of the first extension structure 8 connected to the first deck side 2 and have the other end of the horizontal part 11 of the first extension structure 8 connected to the vertical part 12 of the first extension structure 8, thereby creating the distance between the connection structure 17 and the first deck side 2. The distance is preferably in the range of 40 mm to 150 mm.

Figure 4:
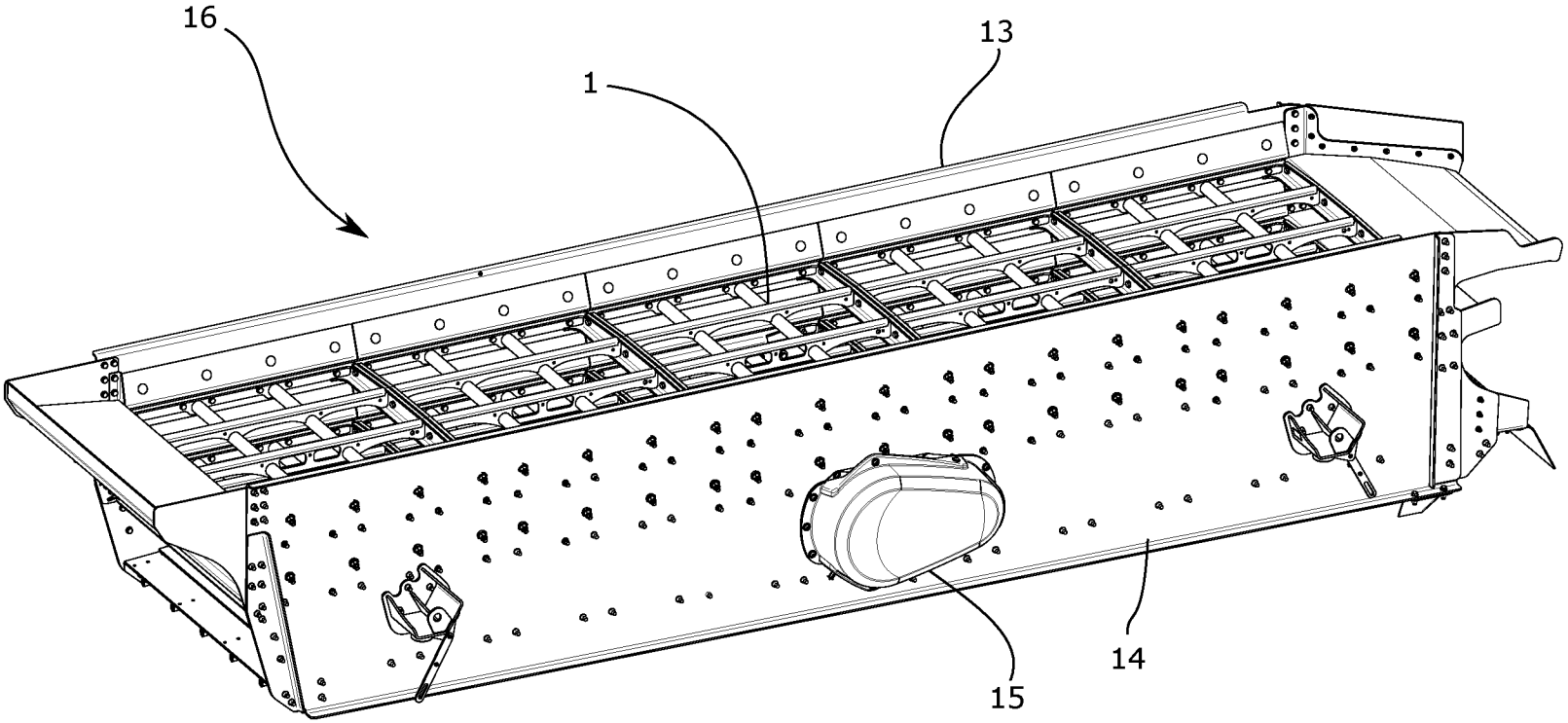
FIG. 4 is a perspective view of a screening arrangement according to an embodiment of the invention, where it is seen that the screening arrangement comprises several modular screen support decks.

Referring now to FIG. 4, which is a perspective view of a screening arrangement 16 according to an embodiment of the invention, where it is seen that the screening arrangement 16 comprises a modular screen support deck 1. The screening arrangement may for example be single deck, double deck, or triple deck screening arrangement but it should be noted that the number of decks is of less relevance to the invention. The screening arrangement may be a horizontal screening arrangement or an inclined screening arrangement. The screening arrangement 16 may be for screening particulate material according to size. The screening arrangement 16 comprises a first side wall 13 and a second side wall 14, each having an inward facing side and an outward facing side. The screening arrangement 16 comprises several modular screen support decks 1, at least one of these modular screen support deck 1 is a modular screen support deck 1 according to the invention, alternatively all the modular screen support decks 1 installed are modular screen support decks according to the invention. The modular screen support deck 1 extends between the inward facing sides of the first side wall 13 and the second side wall 14. Preferably, the first deck side 2 and the second deck side 3 extends in parallel with the first side wall 13 and the second side wall 14. The screening arrangement 16 may also comprise a vibrating mechanism 15, which is configured to vibrate the screening arrangement 16. The vibrating mechanism 15 may be an eccentric drive shaft or a spring vibrator. If the screening arrangement 16 comprises a vibrating mechanism 15 and not all of the modular screen support decks 1 are modular screen support decks 1 according to the invention, it may be preferable to place the modular screen support deck(s) 1 according to the invention adjacent to where the vibrating mechanism 15 is located, to reduce the fatigue in the connections closest to the vibrating mechanism 15.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise. Furthermore, any reference signs in the claims should not be construed as limiting the scope.

In the above the inventive concept has mainly been described with reference to a limited number of examples. However, as is readily appreciated by a person skilled in the art, other examples than the ones disclosed above are equally possible within the scope of the inventive concept, as defined by the appended claims.

The invention claimed is:

1. A modular screen support deck for a screening arrangement, the modular screen support deck comprising:

a first deck side and a second deck side each having an inward facing side and an outward facing side, the first deck side and the second deck side extend in parallel with each other defining a deck plane between the two deck sides, a first extension structure and a second extension structure, the first extension structure being connected to the first deck side and the second extension structure being connected to the second deck side, the first extension structure extending inwardly from the first deck side and comprising a first connection structure being arranged a distance from the first deck side, the second extension structure being connected to the second deck side, extending inwardly from the second deck side, and comprising a second connection structure being arranged a distance from the second deck side, wherein the first extension structure and the second extension structure each comprise a horizontal part extending towards the opposing deck side and a vertical part connected to the horizontal part and extending perpendicular to the deck plane, the vertical part of the first extension structure comprising the first connection structure and the vertical part of the second extension structure comprising the second connection structure, wherein the connection between the horizontal part and the vertical part is configured to act as a vibration damper, and a first cross-member with a first end and a second end, the first end of the first cross-member being connected to the first connection structure, wherein the first extension structure is configured to dampen vibrations in the connection between the first end of the first cross-member and the first connection structure, and the second end of the first cross-member being connected to the second connection structure, wherein the second extension structure is configured to dampen vibrations in the connection between the second end of the first cross-member and the second connection structure.

2. A modular screen support deck according to claim 1, wherein an angle between the horizontal parts of the first extension structure and the second extension structure and the deck plane is in the range of 0 degrees to 15 degrees.

3. A modular screen support deck according to claim 1, wherein the first end and the second end of the first cross-member is connected to the first connection structure and the second connection structure by welding.

4. A modular screen support deck according to claim 1, wherein the modular screen support deck comprises at least two first cross-members.

5. A modular screen support deck according to claim 1, wherein the modular screen support deck comprises a second cross-member with a first end and a second end, a third deck side and a fourth deck side each having an inward facing side and an outward facing side, the third deck side and the fourth deck side extends in parallel with each other perpendicular to the first deck side and the second deck side, ends of the third deck side and the fourth side being connected to the first deck side and the second deck side, and the first end of the second cross-member is connected to the third deck side and the second end the second cross-member is connected to the fourth deck side.

6. A modular screen support deck according to claim 5, where the second cross-member is configured to accommodate at least part of the first cross-member.

7. A modular screen support deck according to claim 5, where the modular screen support deck comprises at least three second cross-members.

8. A modular screen support deck according to claim 6, where the modular screen support deck comprises at least three second cross-members.

9. A modular screen support deck according to claim 1, where the distance between the first connecting structure and the first deck side is in the range of 40 mm to 150 mm, and the distance between the second connecting structure and the second deck side is in the range of 40 mm to 150 mm.

10. A modular screen support deck according to claim 5, where the inward facing side of the third deck side and the fourth deck is folded to form a U-shape.

11. A modular screen support deck according to claim 6, where the inward facing side of the third deck side and the fourth deck is folded to form a U-shape.

12. A modular screen support deck according to claim 7, where the inward facing side of the third deck side and the fourth deck is folded to form a U-shape.

13. A screening arrangement for screening particulate material according to size, comprising:

a first side wall and a second side wall, each having an inward facing side and an outward facing side, and a modular screen support deck according to claim 1, the modular screen support deck extending between said inward facing sides of the first side wall and the second side wall.

14. The screening arrangement according to claim 13, wherein the screening arrangement comprises a vibrating mechanism, which is configured to vibrate the screening arrangement.

15. A mobile material processing plant comprising a screening arrangement according to claim 13.

* * * * *